US011642863B2

(12) United States Patent
Ghiotti et al.

(10) Patent No.: US 11,642,863 B2
(45) Date of Patent: May 9, 2023

(54) FOLDING UNIT AND METHOD FOR FORMING AN EMPTY CARDBOARD BOX BY FOLDING A BLANK AROUND A MANDREL

(71) Applicant: SASIB S.P.A., Castel Maggiore (IT)

(72) Inventors: Roberto Ghiotti, Monte S. Pietro (IT); Matteo Lena, Bologna (IT)

(73) Assignee: SASIB S.P.A., Castel Maggiore (IT)

( * ) Notice: Subject to any disclaimer, the term of this patent is extended or adjusted under 35 U.S.C. 154(b) by 39 days.

(21) Appl. No.: 16/644,706

(22) PCT Filed: Sep. 14, 2018

(86) PCT No.: PCT/IB2018/057071
§ 371 (c)(1),
(2) Date: Mar. 5, 2020

(87) PCT Pub. No.: WO2019/053655
PCT Pub. Date: Mar. 21, 2019

(65) Prior Publication Data

US 2020/0282684 A1 Sep. 10, 2020

(30) Foreign Application Priority Data

Sep. 15, 2017 (IT) ..... 102017000103228

(51) Int. Cl.
*B65B 19/34* (2006.01)
*B65B 35/44* (2006.01)
(Continued)

(52) U.S. Cl.
CPC ..... *B31B 50/324* (2017.08); *B31B 50/282* (2017.08); *B65B 5/024* (2013.01);
(Continued)

(58) Field of Classification Search
None
See application file for complete search history.

(56) References Cited

U.S. PATENT DOCUMENTS 2,209,110 A * 7/1940 Chalmers ..... B65B 19/22 53/529
3,530,773 A 9/1970 Kuhnle et al.
(Continued)

FOREIGN PATENT DOCUMENTS

DE 955128 C 12/1956
EP 0167705 A1 1/1986
(Continued)

OTHER PUBLICATIONS

International Application No. PCT/IB2018/057071, International Search Report and Written Opinion, dated Apr. 2, 2019.

*Primary Examiner* — Nathaniel C Chukwurah
*Assistant Examiner* — Tanzim Imam
(74) *Attorney, Agent, or Firm* — Marshall, Gerstein & Borun LLP

(57) ABSTRACT

Folding unit for forming an empty cardboard box; the folding unit has a mandrel, around which a blank is folded to form the empty cardboard box. The mandrel has at least two parts, which are mobile in respect to one another between an expanded configuration, in which the two parts are further from one another so as to confer a maximum size to the mandrel, and a contracted configuration, in which the two parts are closer to one another so as to confer a minimum size to the mandrel.

29 Claims, 14 Drawing Sheets

(51) Int. Cl.

| | |
|---|---|
| ***B65B 19/22*** | (2006.01) |
| ***B65B 19/12*** | (2006.01) |
| ***B65B 5/06*** | (2006.01) |
| ***B31B 50/32*** | (2017.01) |
| ***B31B 50/28*** | (2017.01) |
| ***B65B 5/02*** | (2006.01) |
| *B31B 100/00* | (2017.01) |
| *B31B 110/35* | (2017.01) |

(52) U.S. Cl.
CPC ..... *B65B 5/06* (2013.01); *B65B 19/12* (2013.01); *B65B 19/22* (2013.01); *B65B 19/34* (2013.01); *B65B 35/44* (2013.01); *B31B 2100/0028* (2017.08); *B31B 2110/35* (2017.08)

(56) References Cited

U.S. PATENT DOCUMENTS

| | | | | | |
|---|---|---|---|---|---|
| 4,616,475 | A | * | 10/1986 | Nagata | B65B 19/24 493/164 |
| 5,120,292 | A | * | 6/1992 | Ueda | B31B 50/322 493/124 |
| 2006/0021298 | A1 | | 2/2006 | Van Caeneghem et al. | |

FOREIGN PATENT DOCUMENTS

| | | | | | |
|---|---|---|---|---|---|
| EP | 1362689 | A2 | * | 11/2003 | B31B 1/00 |
| FR | 2829421 | A1 | * | 3/2003 | B31B 50/00 |
| WO | WO-96/16789 | A1 | | 6/1996 | |
| WO | WO-9616789 | A1 | * | 6/1996 | B29C 53/42 |
| WO | WO-2015/170295 | A1 | | 11/2015 | |
| WO | WO-2015170295 | A1 | * | 11/2015 | B65B 43/52 |
| WO | WO-2017055783 | A1 | * | 4/2017 | A24C 5/35 |

* cited by examiner

FOLDING UNIT AND METHOD FOR FORMING AN EMPTY CARDBOARD BOX BY FOLDING A BLANK AROUND A MANDREL

CROSS-REFERENCE TO RELATED APPLICATIONS

This is the U.S. national phase of International Application No. PCT/IB2018/057071, filed Sep. 14, 2018, which claims the benefit of Italian Patent Application No. 102017000103228, filed Sep. 18, 2017.

TECHNICAL FIELD

The present invention relates to a folding unit and method for forming an empty cardboard box.

The present invention finds advantageous application in forming an empty cardboard box in a packaging machine which produces packets for non-combustible cigarettes, i.e. for the so-called HNB ("Heat Not Burn") cigarettes, which the present invention will make explicit reference without losing generality

PRIOR ART

Recently the new generation cigarettes have been proposed on the market, i.e. the non-combustible cigarettes (HNB cigarettes) in which the tobacco is electrically heated in order to obtain the sublimation of the aromatic substances contained in the tobacco itself.

For the marketing of the new generation cigarettes, a package formed by a cardboard box containing a group of heterogeneous articles (i.e. of a different type) comprising an electronic cigarette, a set of single-use cartridges (i.e. disposable) for the electronic cigarette, and one printed sheet (containing the use and warning instructions).

For the production of the package above described, the use of a packaging machine comprising a formation unit has been proposed, in which the group of heterogeneous articles is manufactured, a folding unit, in which the empty cardboard box is manufactured, an insertion unit, in which the group of heterogeneous articles is inserted inside the cardboard box, and a closing unit, in which the open ends of the cardboard box are closed to complete the manufacturing of the package.

According to a first embodiment, the cardboard boxes are fed, already formed and flattened, to the folding unit and consequently, in the folding unit, each already formed cardboard box is simply erected by rotating two opposite side walls by 90° in respect to the lower and upper base walls; however, this embodiment requires a further packaging machine which forms the cardboard boxes upstream of the folding unit and thus increases the cost and the complexity of the plant.

According to an alternative embodiment, flat blanks are fed to the folding unit, which are folded into a tubular shape and stabilized by means of glue in the folding unit; however, this embodiment presents a low productivity (i.e. the number of pieces that can be produced in an hourly unit) which can be significantly increased only at the expense of the final quality of the cardboard box.

The U.S. Pat. No. 2,209,110A describes a packaging machine provided with a mandrel around which a sheet of wrapping material is folded to manufacture a package; the mandrel comprises two parts which are mobile in respect to one another between an expanded configuration, in which the two parts are further from one another to confer a maximum size to the mandrel, and a contracted configuration, in which the two parts are closer to one another to confer a minimum size to the mandrel.

Patent application WO9616789A1 describes an adjustable-size mandrel fitted in a drum of a packaging machine; the size of the mandrel can be reduced so as to allow an easier removal of the package from the mandrel at the end of the folding and also to perform a quicker format change, which involves the variation in the size of the package.

U.S. Pat. No. 3,530,773A describes a formation mandrel around which a sheet of wrapping material is folded to manufacture a package; the mandrel comprises two parts which are mobile in respect to one another between an expanded configuration, in which the two parts are further from one another to confer a maximum size to the mandrel, and a contracted configuration, in which the two parts are closer to one another to confer a minimum size to the mandrel.

DESCRIPTION OF THE INVENTION

The object of the present invention is to provide a folding unit and method for forming an empty cardboard box, which unit and folding method allow to achieve high productivity and are, at the same time, easy and inexpensive to manufacture.

According to the present invention, a folding unit and method are provided for forming an empty cardboard box, as claimed in the appended claims.

The claims describe preferred embodiments of the present invention forming an integral part of the present disclosure.

BRIEF DESCRIPTION OF THE DRAWINGS

The present invention will now be described with reference to the accompanying drawings, which illustrate a non-limiting example of embodiment, wherein.

PREFERRED EMBODIMENTS OF THE INVENTION

Figure 1:
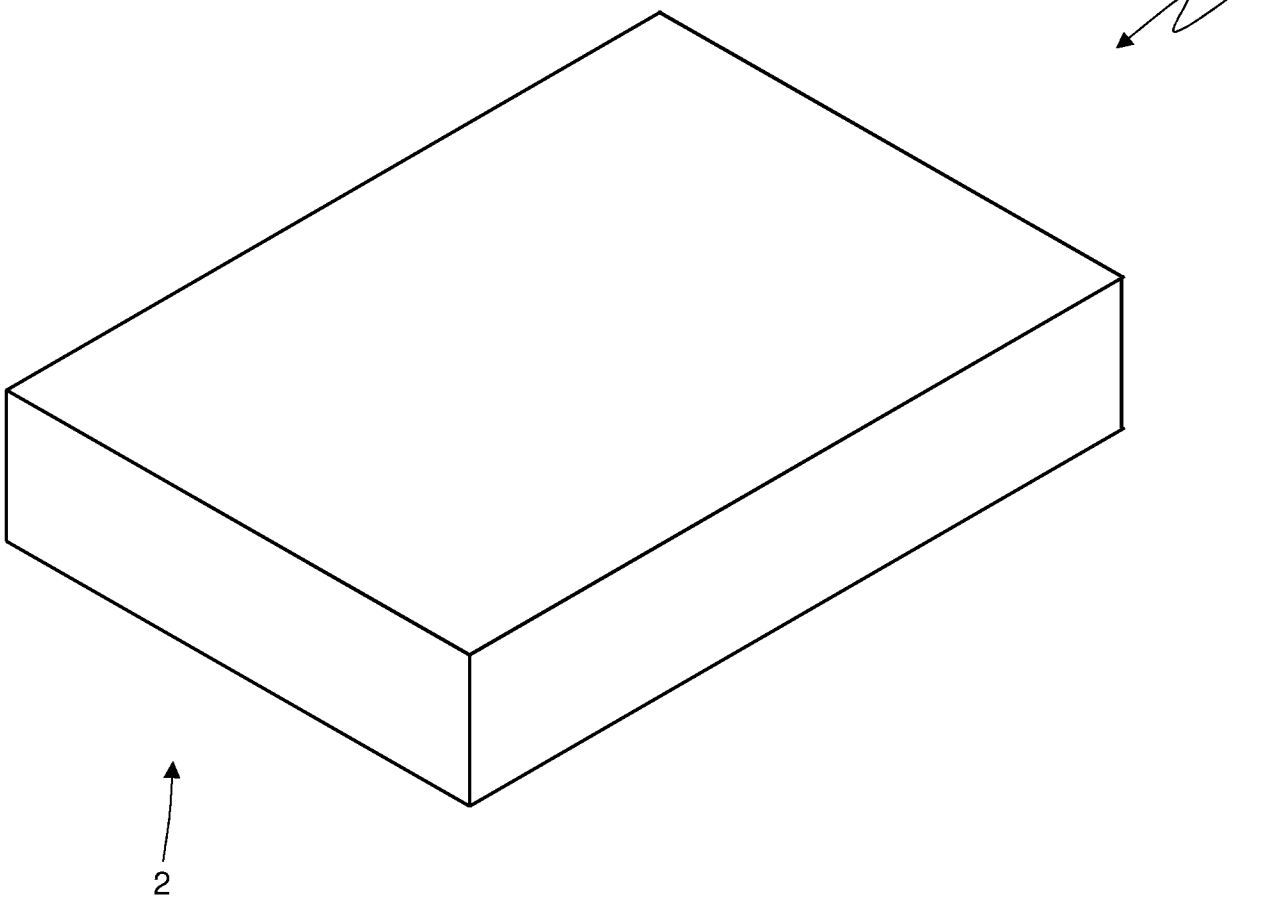
FIG. 1 is a perspective view of a package for a HNB electronic cigarette.

In FIG. 1, number 1 denotes as a whole a package for a HNB electronic cigarette.

Figure 2:
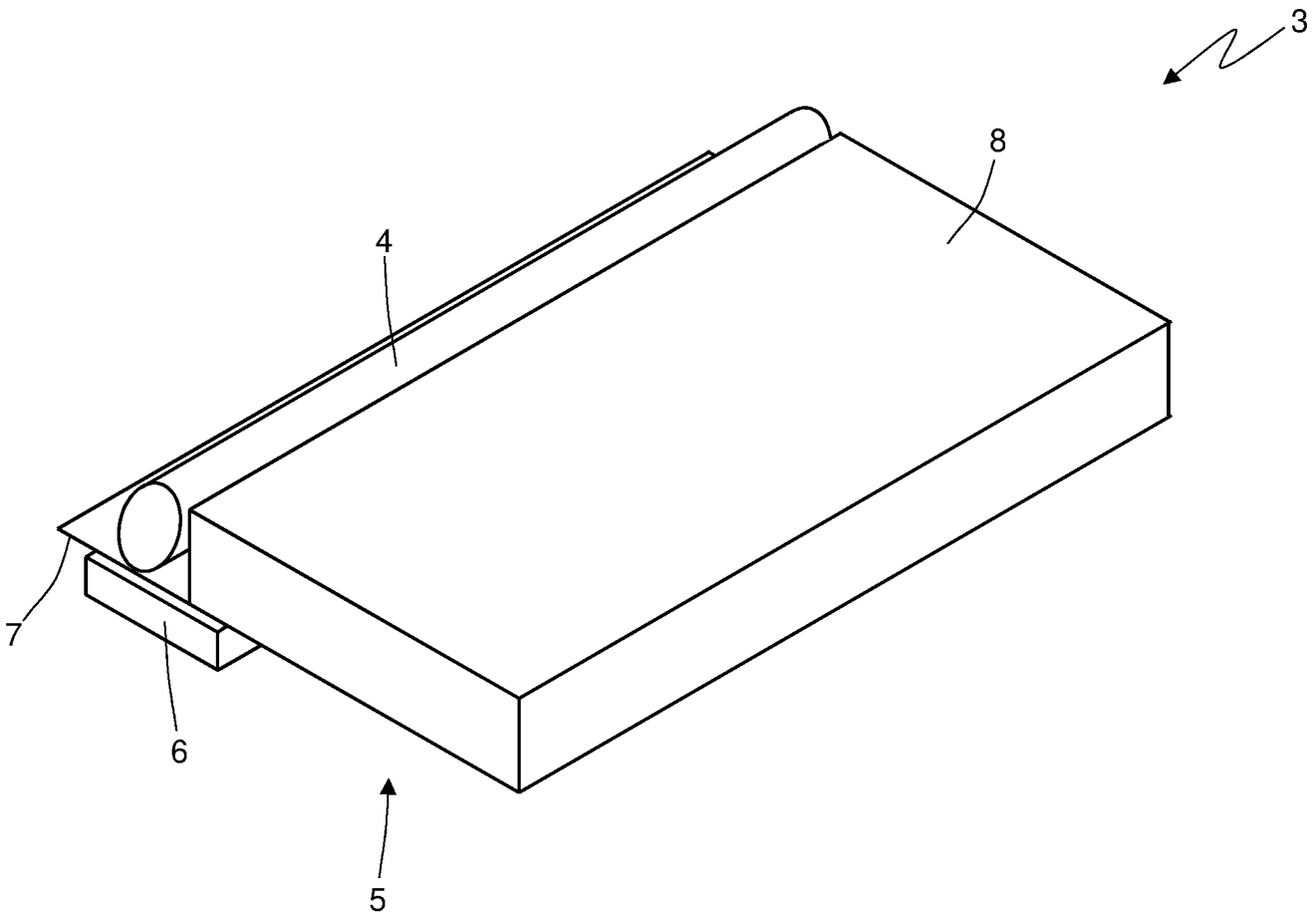
FIG. 2 is a perspective view of a heterogeneous group of articles contained in the package of FIG. 1.

The package 1 comprises a cardboard box 2 made of cardboard (or other similar material) with a parallelepiped shape inside which a group 3 of heterogeneous articles (i.e. of different types) is contained, which is illustrated in FIG. 2.

In the non-limiting embodiment illustrated in FIG. 2, the group 3 of heterogeneous articles comprises an electronic cigarette 4, a set 5 of single-use cartridges (i.e. disposable) for the electronic cigarette 4 and a printed sheet 6 (containing the use and warning instructions and folded in an "accordion-like" manner).

The set 5 of disposable cartridges comprises a rigid or semi-rigid base 7 which has an extension equal to the width of the package 1 (so as to be contained in the package 1 without clearance and therefore not "shaking" inside the package 1) and a casing 8 (schematically illustrated in FIG. 2) which rises from the base 7 and houses the disposable cartridges; according to a possible embodiment, the set 5 is manufactured as a blister pack and therefore the casing 8 has several transparent plastic chambers closed at the bottom by an aluminium sheet.

Figure 3:
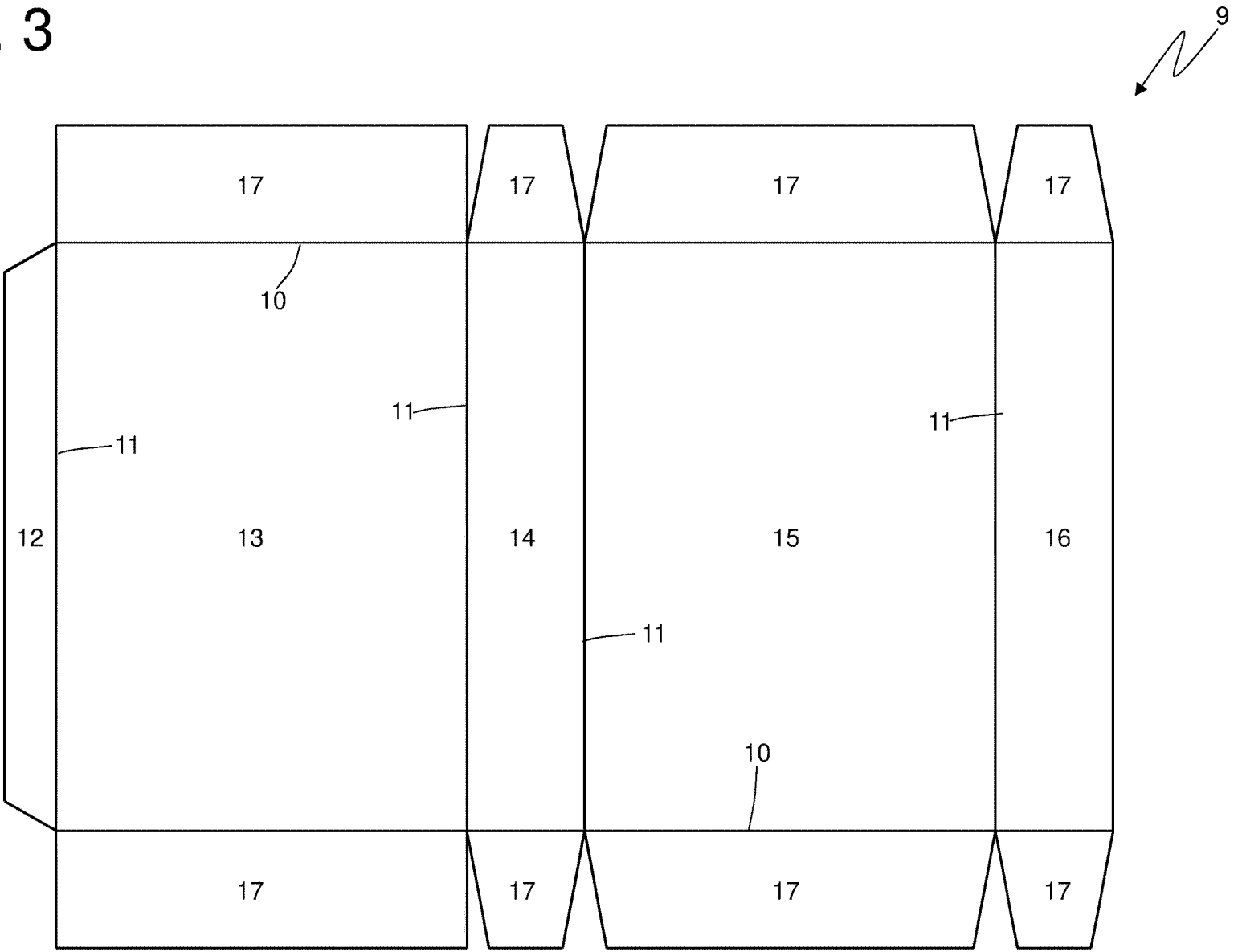
FIG. 3 is a plan view of a blank which is folded and glued so as to manufacture a cardboard box of the package of FIG. 1.

The cardboard box 2 is manufactured by folding and stabilizing by means of gluing a blank 9 of cardboard illustrated in FIG. 3.

The blank 9 comprises two pre-weakened transversal folding lines 10 and four pre-weakened longitudinal folding lines which define, between the pre-weakened transverse folding lines 10, a connecting tab 12 and four panels 13-16 which form four corresponding side walls of the cardboard box 2. Each panel 13-16 has a pair of corresponding fins 17, which are arranged on opposite sides of the panel 13-16, are separated from the panel 13-16 by the two pre-weakened transversal folding lines 10, and are folded so as to form two end walls of the cardboard box 2.

During forming the cardboard box 2, the connecting tab 12 is glued (i.e. provided with glue) so as to stabilize the tubular shape of the cardboard box 2 by permanently adhering the connecting tab 12 to an inner surface of the panel 16. During the closing of the open ends of the cardboard box 2, the fins 17 of the panel 13 are glued (i.e. provided with glued) so as to stabilize the two end walls by permanently adhering each fin 17 of the panel 13 to the underlying fin 17 of the panel 16.

Figure 4:
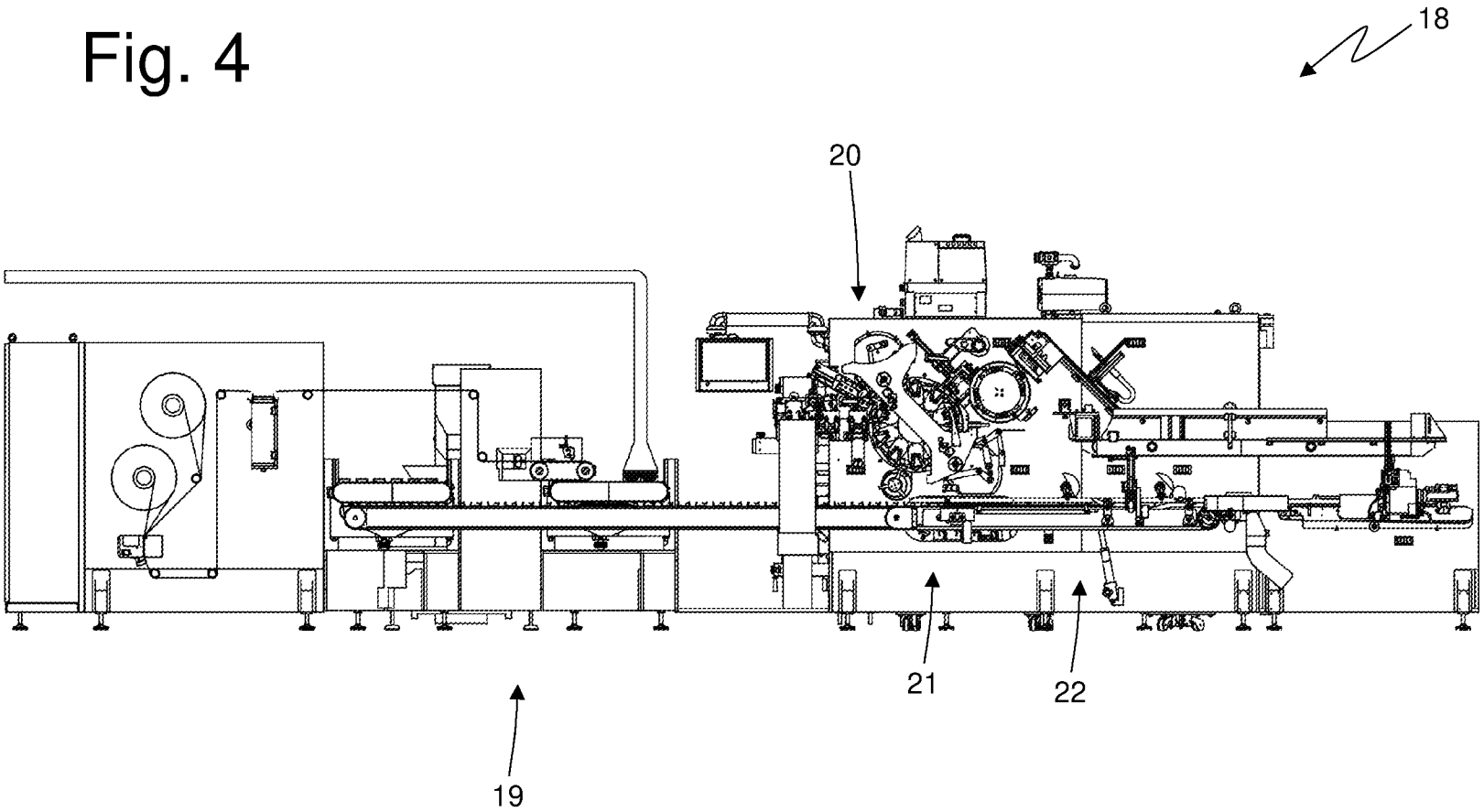
FIG. 4 is a front view and with the removal of parts for clarity of a packaging machine that manufacture the package of FIG. 1.

In FIG. 4 number 18 denotes as a whole a packaging machine that manufactures the package 1 described above by forming the group 3 of articles, by forming the empty cardboard box 2 (i.e. without contents), by inserting the group 3 of articles into the cardboard box 2, and finally by closing the ends of the cardboard box 2.

According to a preferred but non-binding embodiment, the packaging machine 18 operates with a continuous motion, i.e. the main conveyors of the packaging machine 18 advance with a constant speed devoid of stops. Alternatively, the packaging machine 18 could operate intermittently, i.e. the main conveyors of the packaging machine 18 advance by cyclically alternating a motion step and a still step.

The packaging machine 18 comprises a formation unit 19, in which the group 3 of heterogeneous articles is formed, a folding unit 20, in which the empty cardboard box 2 is manufactured (by leaving the two opposite ends of the cardboard box 2 open), one insertion unit 21, in which the group 3 of heterogeneous articles is longitudinally inserted into the cardboard box 2 previously manufactured, and a closing unit 22, in which the open ends of the cardboard box 2 are closed (by folding and overlapping the fins 17) in order to complete the manufacturing of the package 1.

Figure 5:
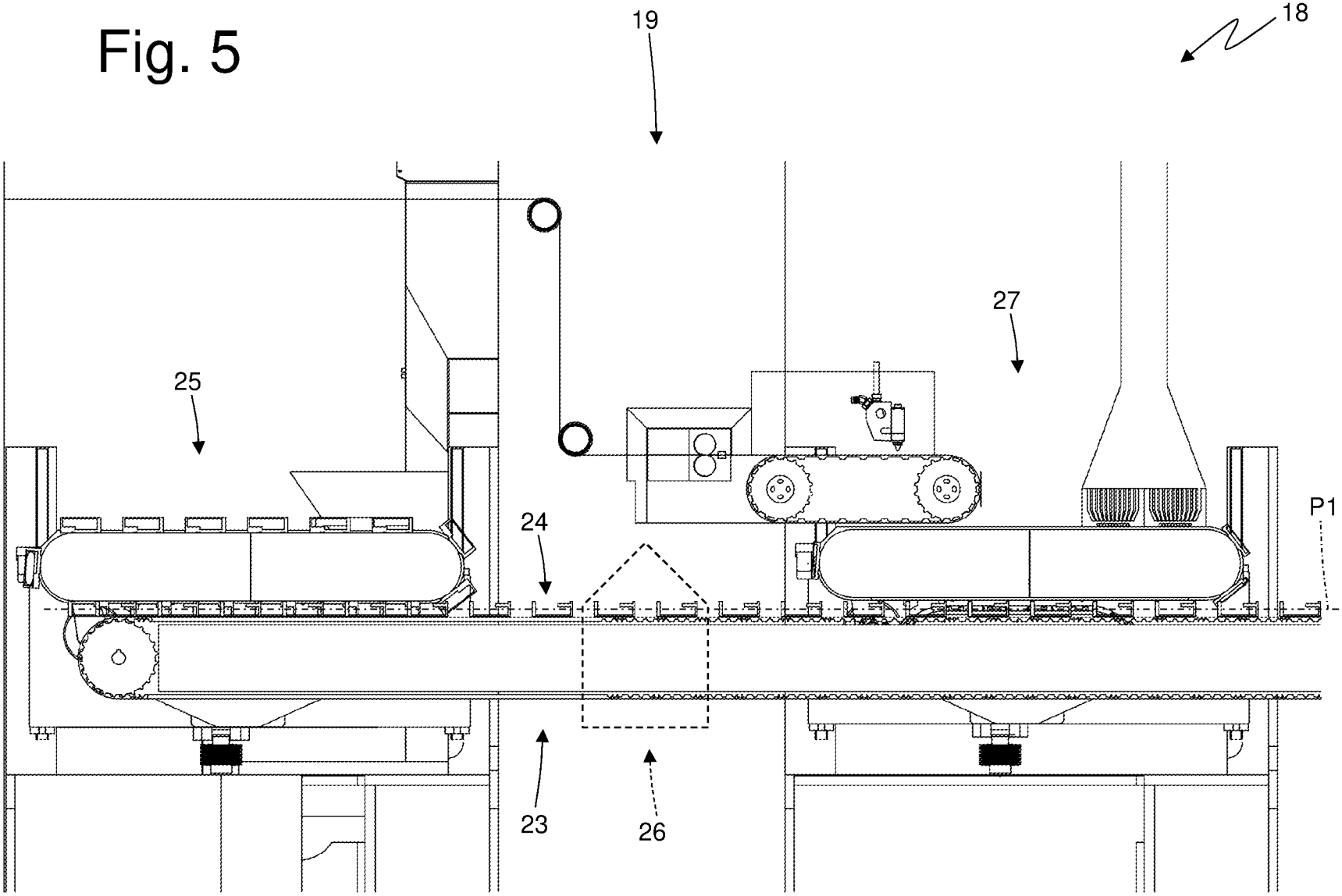
FIG. 5 is a front view and with the removal of parts for clarity of a formation unit of the packaging machine of FIG. 4.

As illustrated in FIG. 5, the formation unit 19 comprises a formation conveyor 23 which feeds a series of formation pockets 24 along a rectilinear and horizontal formation path P1; preferably, the formation conveyor 23 comprises (at least) a flexible belt which is closed in a loop around two end pulleys (at least one of which is motorized) and supports the formation pockets 24.

The formation unit 19 comprises a feeding device 25 which is arranged along the formation path P1 and inserts a corresponding mould 6 into each formation pocket 24, a feeding device 26 which is arranged along the formation path P1, downstream of the feeding device 25 and inserts a corresponding electronic cigarette 4 into each formation pocket 24, and a feeding device 27 which is arranged along the formation path P1 downstream of the feeding device 26 and inserts a corresponding group 3 of articles into each formation pocket 24.

Each feeding device 25, 26 or 27 comprises its own feeding conveyor which is arranged next to the formation conveyor 23 and has a series of feeding pockets which, for a given section, are fed parallel and in a synchronous manner to the formation pockets 24. In use each feeding pocket of a feeding conveyor receives a corresponding article (an electronic cigarette 4, a set of cartridges 5, or a printed sheet 6) in a first area of its path and while the feeding conveyor is still. Furthermore, in use each feeding pocket of a feeding conveyor releases a corresponding article (an electronic cigarette 4, a set of cartridges 5 or a printed sheet 6) in a second area of its path and while the feeding conveyor is moving so as to feed the feeding pocket synchronously with a forming pocket 24; the transfer of an article (an electronic cigarette 4, a set 5 of cartridges or a printed sheet 6) from a feeding pocket to a forming pocket 24 takes place by means of a pusher which synchronously moves with the same pockets and performs a push stroke perpendicular to the forming P1 path.

When the packaging machine 18 operates with a continuous motion, the formation conveyor 23 has a constant speed devoid of stops whereas the feeding conveyor of the feeding devices 25, 26 and 27 can have an intermittent motion which cyclically alternates the still steps (in which the articles are inserted into the feeding pockets) and the motion steps (in which the articles are transferred from the feeding pockets to the corresponding forming pockets 24).

According to a different embodiment, the two feeding devices 26 and 27 are integrated to one another to initially combine an electronic cigarette 4, a set 5 of cartridges on the outside of the formation conveyor 23 and therefore to feed together the electronic cigarette 4 and the set 5 of cartridges to a formation pocket 24 of the formation conveyor 23.

Figure 6:
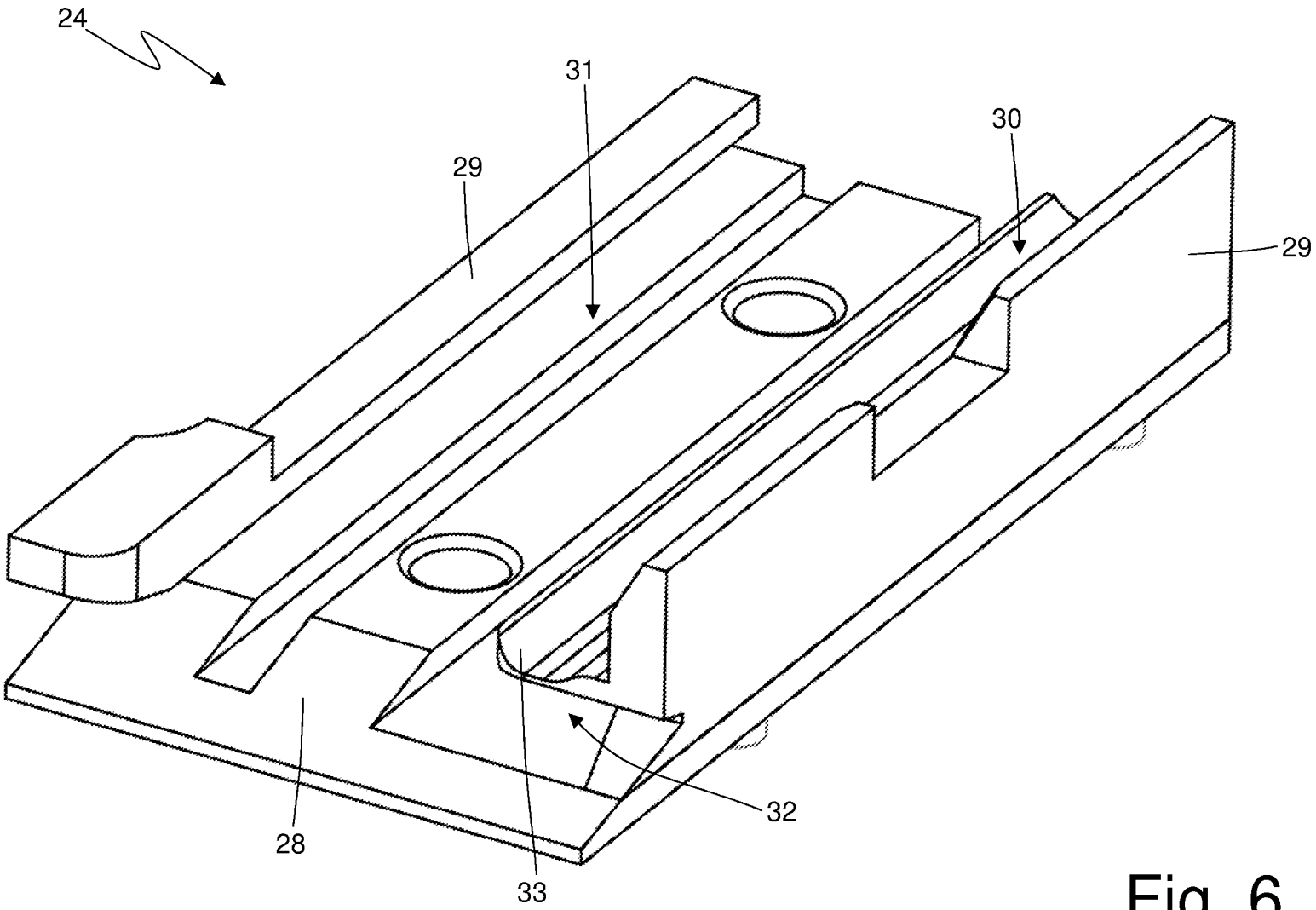
FIGS. 6 and 7 are two different perspective views of a tray of the formation unit of FIG. 5.
Figure 7:
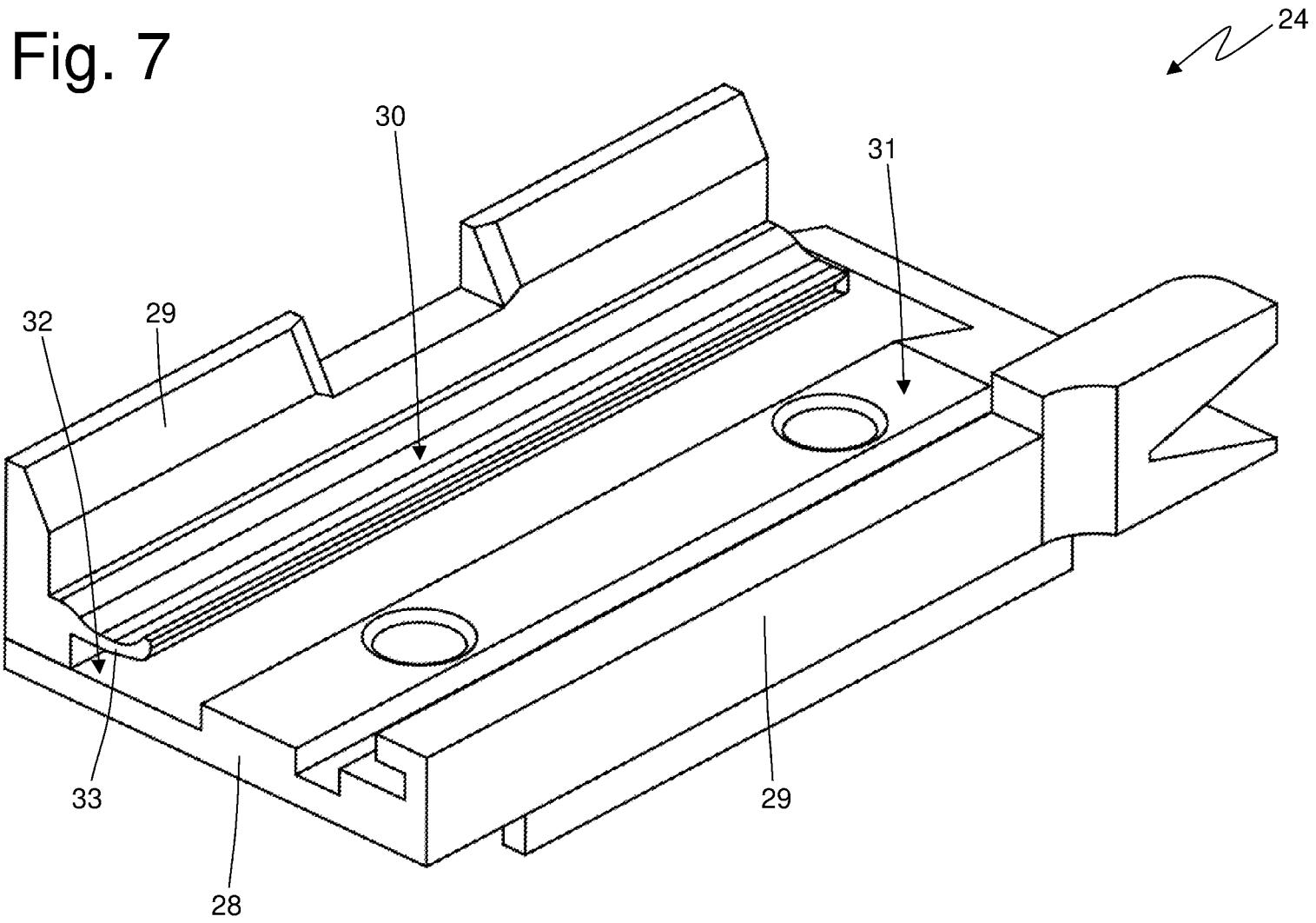
Figure 8:
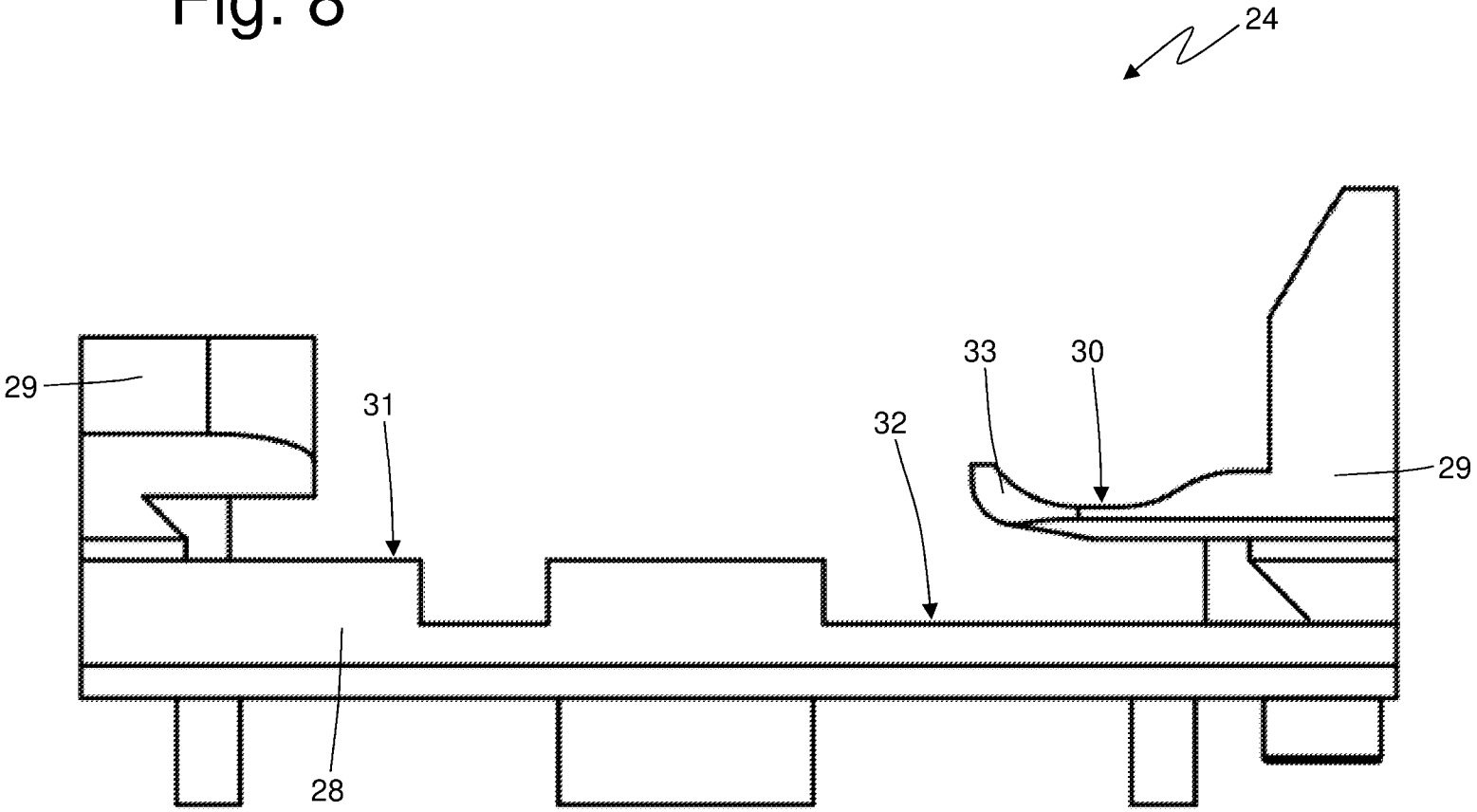
FIG. 8 is a front view of the tray of FIGS. 6 and 7.

As illustrated in FIGS. 6, 7 and 8, each formation pocket 24 comprises a base wall 28 which is rigidly fixed to the formation conveyor 23 by means of a pair of screws (in FIGS. 6 and 7 the two through holes, through which the screws pass, are shown); from the base wall 28 of each formation pocket 24 two opposite side walls 29 rise, which laterally contain the group 3 of articles. Inside each formation pocket 24 a seat 30 is obtained, which is shaped to house an electronic cigarette 4, a seat 31 shaped to house a set 5 of cartridges, and a seat 32 shaped to house a mould 6. In particular, in each formation pocket 24 an appendix 33 is provided, which rises in a cantilever fashion from a side wall 29 and defines the seat 30 shaped to house an electronic cigarette 4; under the appendix 33 a space for housing one end of the base 7 of a set 5 of cartridges is provided.

According to a preferred, non-binding embodiment, illustrated in FIG. 6, the base wall 28 of each formation pocket 24 has a chute (i.e. an inclined plane that confers a progressively increasing thickness to the base wall 28) which is arranged on the side of the formation pocket 24 where the set 5 of cartridges is inserted.

Figure 9:
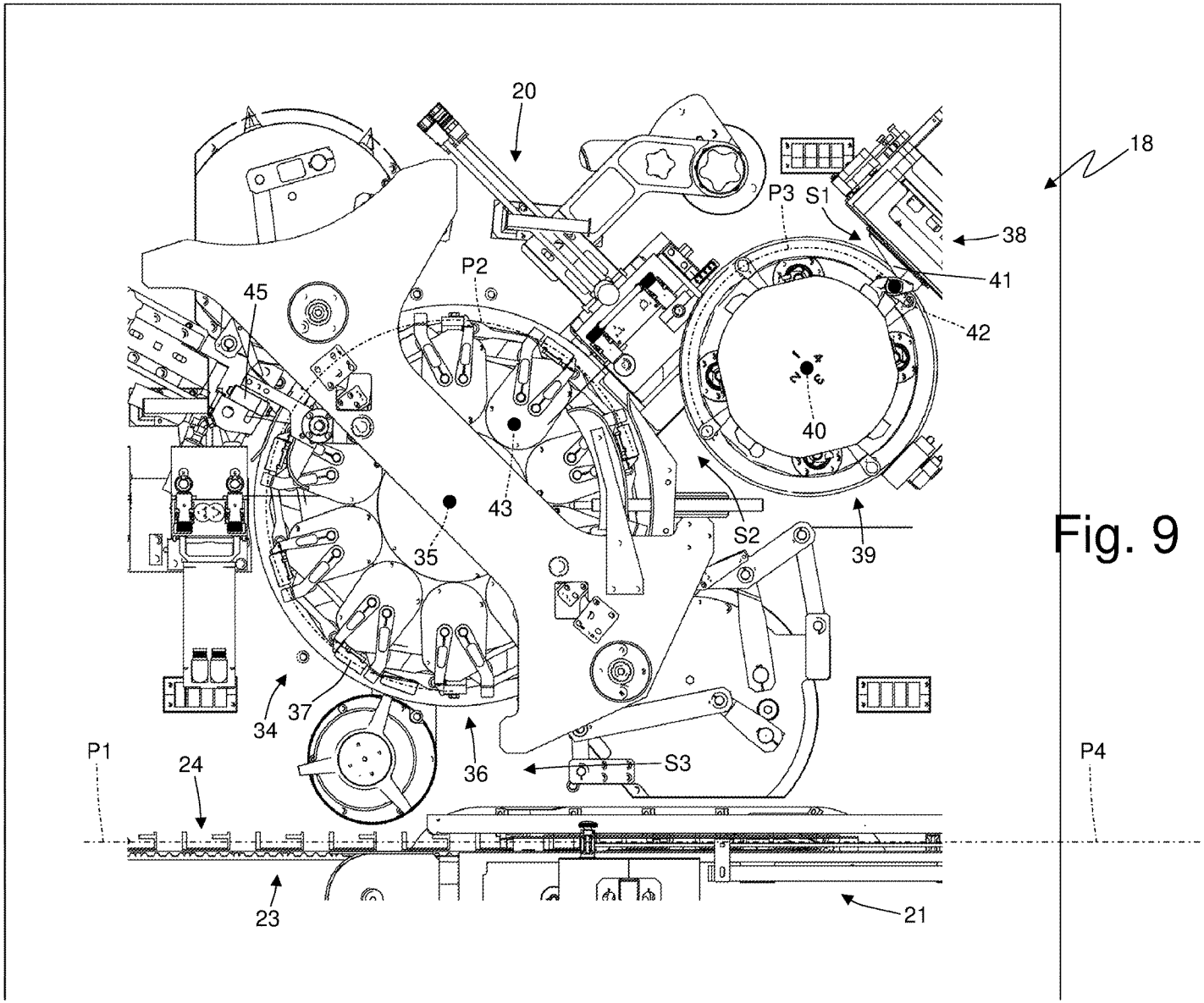
FIG. 9 is a front view and with the removal of parts for clarity of a folding unit of the packaging machine of FIG. 4.
Figure 10:
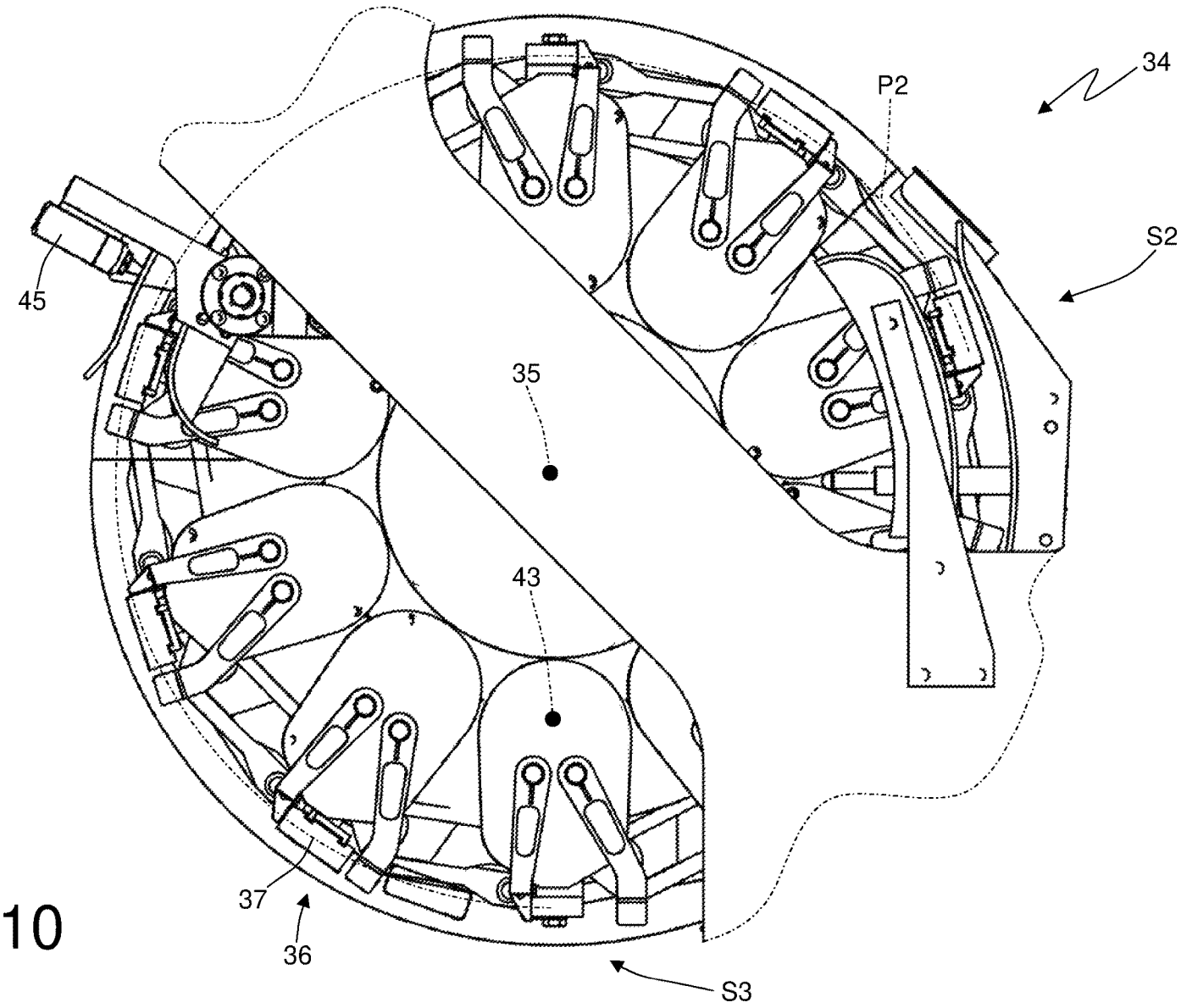
FIG. 10 is a front view and with the removal of parts for clarity of a folding drum of the folding unit of FIG. 9.

As illustrated in FIGS. 9 and 10, the folding unit 20 comprises a folding drum 34 which is vertically arranged, is mounted rotatable about a horizontal rotation axis 35 and is adapted to rotate with a continuous motion (i.e. with a constant speed) around the rotation axis 35 (counter clockwise as illustrated in FIGS. 9 and 10) for cyclically advancing along a circular folding path P2. The folding drum 34 supports a plurality of folding heads 36, each of which is provided with a mandrel 37 with a parallelepiped shape around which a corresponding blank 9 is folded into a tubular shape (i.e. so as to assume a tubular shape) to form an empty cardboard box 2; in other words, each mandrel 37 is adapted to receive a corresponding blank 9 which is folded with a tubular shape (i.e. so as to assume a tubular shape) to form (along the folding path P2) an empty cardboard box 2.

The folding unit 20 further comprises a storage unit 38 which is arranged close to the folding drum 34 and houses a pile of blanks 9 and a feeding drum 39 which is arranged between the storage unit 38 and the folding drum 34 to extract the blanks 9 from an outlet mouth of the storage unit 38 and feed the blanks 9 in succession to the mandrels 37 of the corresponding folding heads 36. The feeding drum 39 is arranged vertically, is mounted rotatable about a horizontal rotation axis 40 (and parallel to the rotation axis 36) and is adapted to rotate with a continuous motion (i.e. with a constant speed) around the rotation axis 40 to cyclically advance along a circular feeding path P3. The feeding drum 39 supports a group of sucking holding heads 41, each of which is adapted to hold a corresponding blank 9 during the transfer of the blank 9 from the outlet mouth of the storage unit 38 to the mandrel 37 of a corresponding folding head 36.

The movement of the feeding drum 39 cyclically moves each holding head 41 between a pickup station S1 (where the feeding path P3 begins) in which the holding head 41 picks up a blank 9 from the outlet mouth of the storage unit 38 and a feeding station S2 (where feeding path P3 ends) in which the holding head 41 lays the flat blank 9 on a major (i.e. larger) wall of the mandrel 37 of the corresponding folding head 36; each flat blank 9 (as illustrated in FIG. 3) is coupled to the mandrel 37 of the corresponding folding head 36 by laying the panel 15 (or, alternatively, the panel 13) of the blank 9 to a major (i.e. larger) wall of the mandrel 37. According to a preferred but not limiting embodiment, each mandrel 37 holds the corresponding blank 9 by suction, i.e. the major wall of the mandrel 37 on which the panel 15 is laid (or, alternatively, the panel 13) of the blank 9 has a series of holes which can be connected to a suction source.

In the embodiment illustrated in the accompanying figures, in the feeding station S2 each blank 9 is laid flat on the mandrel 37 of the corresponding folding head 36. According to an alternative not illustrated, each blank 9 is folded into a "U" or "L" shape on the mandrel 37 of the corresponding folding head 36; this "U" or "L" folding of the blank 9 can be carried out before placing the blank 9 on the mandrel 37 or simultaneously while laying the blank 9 on the mandrel 37.

In the preferred embodiment illustrated in the accompanying figures, each holding head 41 is hinged to the feeding drum 39 so as to rotate (due to a camming system) relative to the feeding drum 39 around a rotation axis 42 which it is parallel and spaced apart from the rotation axis 40; the relative movement between each holding head 41 and the feeding drum 39 is performed so as to cause the holding head 41 to have a particular orientation in the moments in which the holding head 41 receives or releases the corresponding blank 9. In the pickup station S1, each holding head 41 is rotated around the rotation axis 42 initially in advance and thereafter delayed with respect to the rotation of the feeding drum 39 for coupling the holding head 41 to the outlet mouth of the storage unit 38. Similarly, in the feeding station S2, each holding head 41 is rotated around the rotation axis initially in advance and subsequently delayed with respect to the rotation of the feeding drum 39 for coupling the holding head 41 with the corresponding folding head 36 of the folding drum 34.

The movement of the folding drum 34 cyclically moves each folding head 36 between the feeding station S2 (where the folding path P2 starts), in which the folding head 36 receives a blank 9 from a corresponding holding head 39 and a transfer station S3 (where the folding path P2 ends), in which the folding head 36 releases an empty cardboard box 2 (obtained by folding the blank 9) to the insertion unit 21.

In the preferred embodiment illustrated in the accompanying figures, each folding head 36 is hinged to the folding drum 34 so as to rotate (by a cam actuating system) relative to the folding drum 34 around a rotation axis 43 which it is parallel and spaced apart from the rotation axis 35; the relative movement between each folding head 36 and the folding drum 34 cause the folding head 36 to have a particular orientation in the moments in which the folding head 36 receives the corresponding blank 9 and releases the corresponding empty cardboard box 2. In the feeding station S2, each folding head 36 is rotated around the rotation axis 43 initially in advance and subsequently delayed with respect to the rotation of the folding drum 34 so as to couple the folding head 36 with the corresponding holding head 41 of the feeding drum 39. Similarly, in the transfer station S3, each folding head is rotated around the rotation axis 43 initially in advance and subsequently delayed with respect to the rotation of the folding drum 34 so as to couple the folding head 36 with a refining conveyor 44 of the insertion unit 21 (described in the following).

The folding unit 20 comprises a gluing device 25, which is arranged near the folding drum 34 and along the folding path P2 for applying glue (preferably hot, i.e. preferably quick-setting) to the outer surface of the connecting tab 6 of each blank 9 (during the subsequent folding of the blank 9, the outer surface of the connecting tab 6 will overlap the inner surface of the panel 10 so as to cause a permanent gluing between the connecting tab 6 and the panel 10). In the embodiment schematically illustrated in FIGS. 9 and 10, the gluing device 45 is of the spray type, i.e. it comprises one or more glue guns which are activated to supply a pressurized glue spray towards the connecting tab 6 of each blank 9.

The folding unit 13 comprises a series of folding devices (per se of known type) which are arranged near the folding drum 34 and along the folding path P2 for folding each blank 9 into a tubular shape, around the corresponding mandrel 37, i.e. to wrap each blank 9 having a tubular shape around the corresponding mandrel 37.

Figure 11:
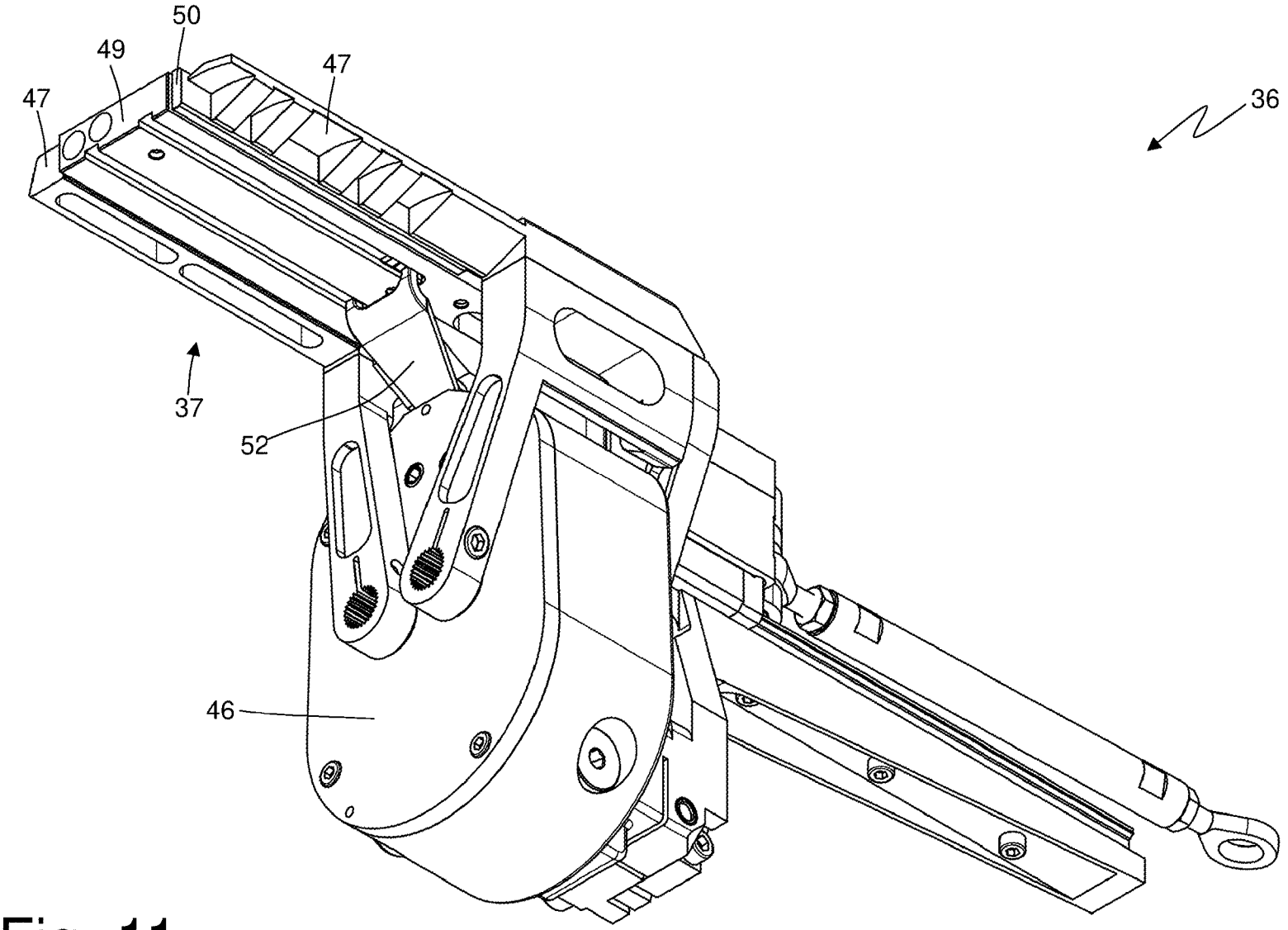
FIG. 11 is a perspective view of the folding head of a folding drum of FIG. 10.
Figure 12:
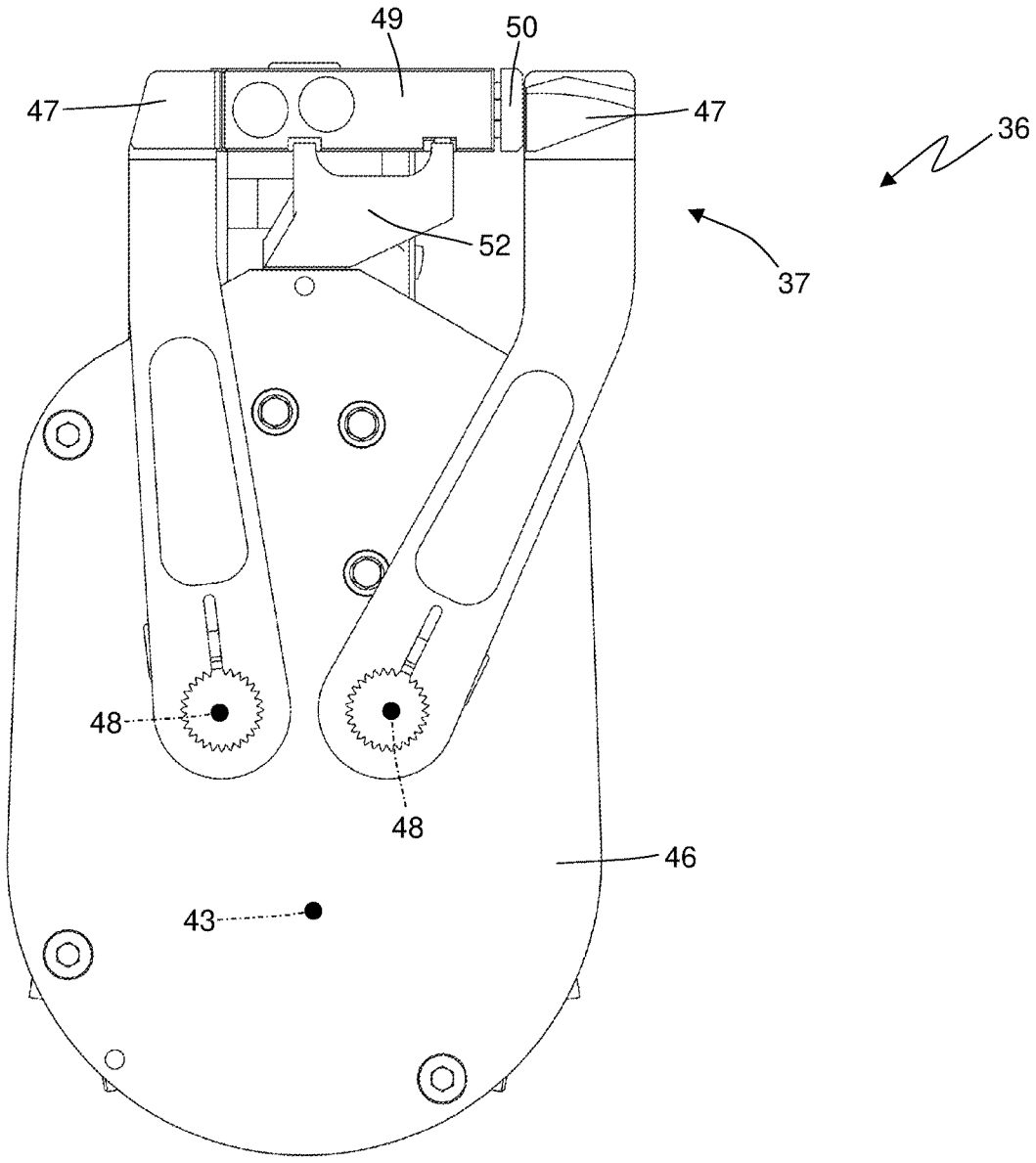
FIG. 12 is a front view of the folding head of FIG. 11.

As better illustrated in FIGS. 11 and 12, each folding head 36 comprises a support body 46 which is hinged to the folding drum 34 so as to rotate around the corresponding rotation axis 43. In each folding head 36 the body 46 bears the mandrel 37 which is mounted on the support body so as to axially slide along an axial translational direction, i.e. parallel to the rotation axis 43, between a work position (illustrated for example in FIGS. 11 and 12), in which the mandrel 37 completely protrudes in a cantilever fashion from the folding head 36 (i.e. it is completely external to the folding head 36) and a release position, in which the mandrel 37 moves backwards from the work position (returning towards the folding head 36 and towards the folding drum 34) of a stroke (slightly) greater than the axial extension of the empty cardboard box 2. In this way, by moving from the work position to the transfer position each mandrel 37 can be axially and completely unravelled from the corresponding empty cardboard box 2 that has just been formed. Along the folding path P2, the mandrels 37 assume the work position everywhere except in the transfer station S3 and the mandrels 37 assume the release position only in the transfer station S3 (according to methods better described in the following). The displacement of the mandrels 37 between the work position and the displacement position and along the translation direction is preferably, but not necessarily, controlled by a cam actuating system which is set into motion by the rotation of the folding drum 34 around the rotation axis 35.

Each folding head 36 further comprises two locking elements 47, which are arranged on opposite sides of the mandrel 37 (i.e. they enclose the mandrel 37 between one another) and are hinged to the support body 46 so as to rotate, relative to the support body 46, between a locking position (illustrated in FIGS. 11 and 12), in which each locking element 47 is pressed against a corresponding side wall of the mandrel 37, and a release position, in which each locking element 47 is relatively far from a corresponding side wall of the mandrel 37. Along the folding path P2, the two locking elements 47 of each folding head 36 assume the release position at the feeding station S2 so as to allow to fold the blank 9 around the folding mandrel 37, downstream of the feeding station S2 in which the blank 9 is laying flat on the mandrel 37; as soon as the blank 9 has been folded around a side wall of the mandrel 37, the corresponding locking element 47 is moved into the locking position to prevent unwanted movements of the blank 9 relative to the mandrel 37 and to apply in the glued areas of the blank. 9 (i.e. provided with glue, therefore to the panel 16 overlapping the connecting tab 12) a high pressure which allow an optimal gluing. Finally, along the folding path P2, the two locking elements 47 of each folding head 36 assumes the release position at the transfer station S3 so as to allow the empty cardboard box 2 to be axially extracted from the mandrel 37.

It is important to note that in each folding head 36 the two locking elements 47 have independent movements, i.e. a locking element 47 can rotate around the rotation axis 48 between the locking position and the release position in a completely independent manner from the other locking element 47.

In the preferred embodiment illustrated in the accompanying figures, each folding head 36 comprises two locking elements 47. According to an alternative not illustrated, each folding head 36 comprises a single locking element 47 arranged at the glued areas of the blank 9 (i.e. provided with glue, therefore the panel 16 overlapping the connecting tab 12). According to a further alternative not illustrated, each folding head 36 is completely devoid of the locking elements 47.

Figure 13:
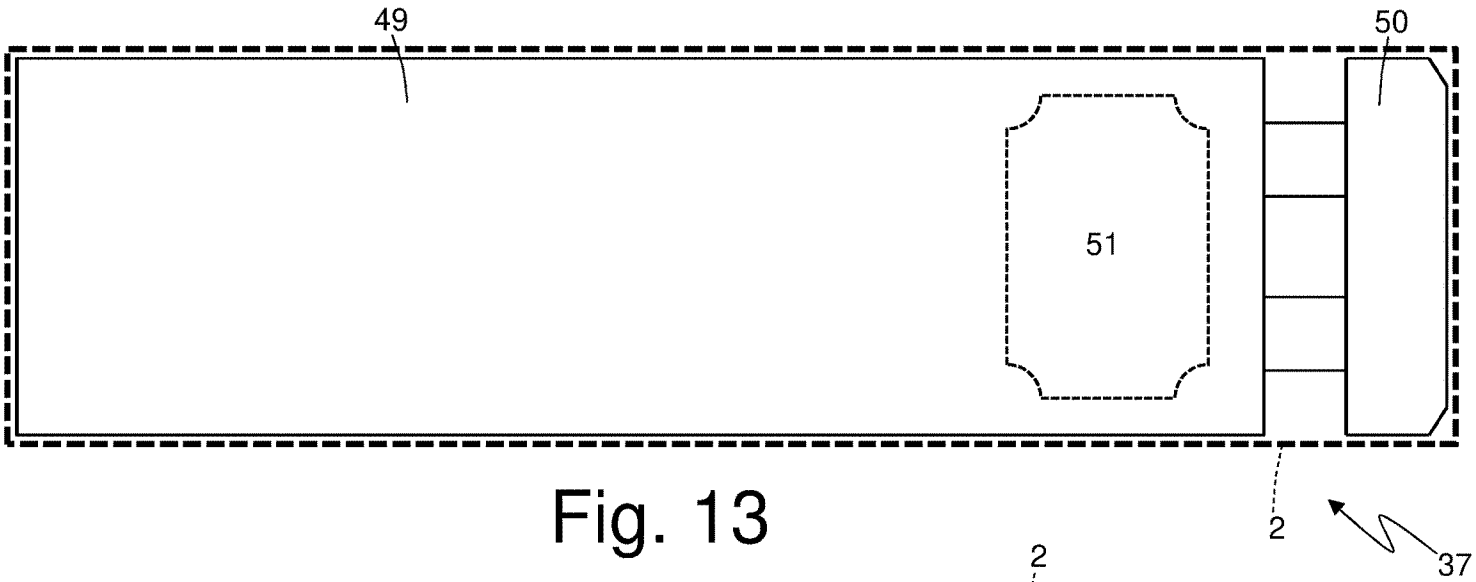
FIGS. 13 and 14 are two front and schematic views of a mandrel of the folding head of FIG. 11 in an expanded configuration and in a contracted configuration, respectively.
Figure 14:
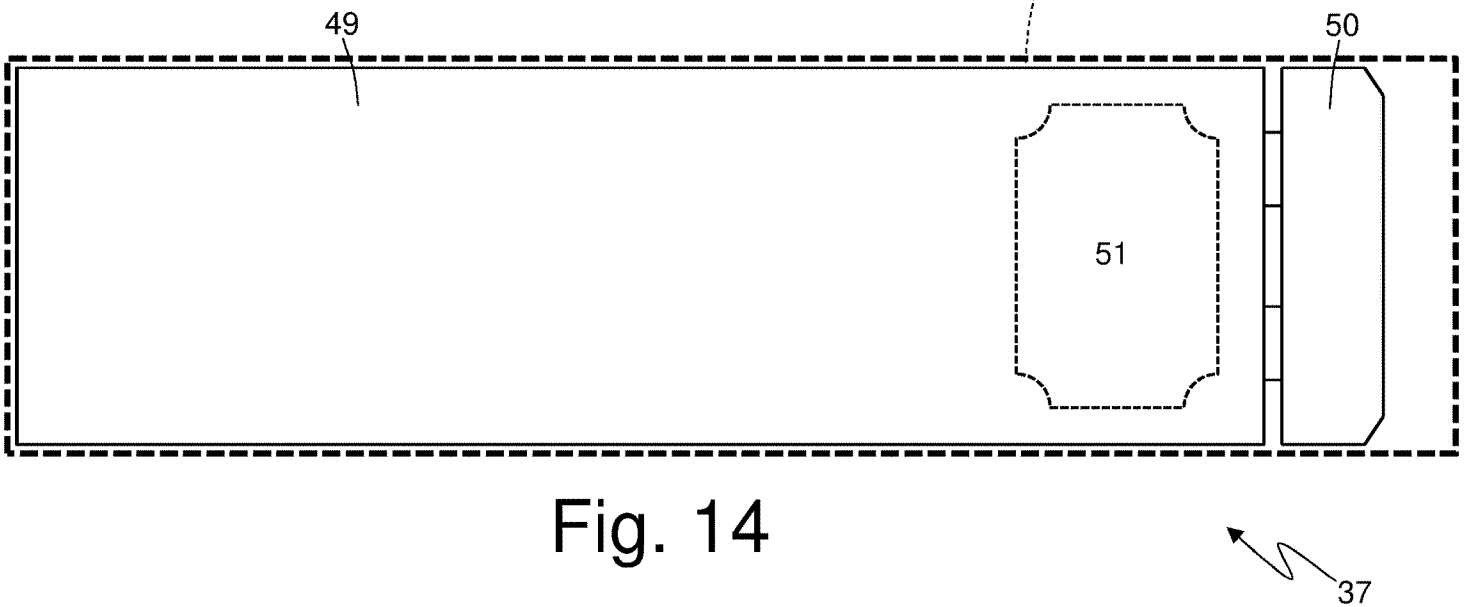

According to what is better illustrated in FIGS. 13 and 14, each mandrel 37 comprises a fixed part 49 and a movable part 50 which is mounted in a sliding manner relative to the fixed part 49 to translate between an expanded configuration (illustrated in FIG. 13), in which the mobile part 50 it is further from the fixed part 49 thus conferring a greater size to the mandrel 37 (i.e. a larger cross section, i.e. maximum) and a contracted configuration (illustrated in FIG. 14), in which the movable part 50 is closer from the fixed part 49 thus conferring a minor size to the mandrel 37 (i.e. a smaller cross section, i.e. minimum). In other words, the movable part 50 of the mandrel 37 is fitted in a projecting manner on the fixed part 49 of the mandrel 37 so as to linearly slide relative to the fixed part 49.

In each mandrel 37, the expanded configuration (illustrated in FIG. 13) confers the largest, i.e. maximum, cross section to the mandrel 37, which is equal, with a substantially null clearance, to the inner cross section of the cardboard box 2 while the contracted configuration (illustrated in FIG. 14) confers the smallest, i.e. minimum, cross section to the mandrel 37, which is substantially smaller than the inner cross section of the cardboard box 2. For each mandrel 37 the expanded configuration (illustrated in FIG. 13) is used during the folding of the blank 9 because the expanded configuration allows to obtain a very precise and straight folding of the blank 9 (i.e. it allows to obtain the maximum folding quality) and the contracted configuration (illustrated in FIG. 14) is used only when the empty cardboard box 2 has to be unravelled from the mandrel 37 in that, by creating a clearance between the empty cardboard box 2 and the mandrel 37 it is much easier (i.e. it requires less force and therefore does not damage the cardboard box 2 that has just been formed) to unravel the empty cardboard box 2 from the mandrel 37.

Accordingly, along the folding path P2, the mandrels 37 assume the expanded configuration everywhere except in the transfer station S3 and the mandrels 37 assume the contracted configuration only in the transfer station S3.

Normally, the sizing of the cross section of a mandrel is always a compromise between the antithetical necessity of giving the mandrel an equal cross section, with a substantially null clearance, to the inner cross section of the cardboard box in order to obtain an optimal folding and to confer a cross section much smaller than the inner cross section of the cardboard box to the mandrel, so as to allow an easy unravelling of the cardboard box from the mandrel once the forming of the cardboard box has been completed (i.e. without having to exert a very high force on the cardboard box, which could damage the cardboard box, but that is necessary to overcome the friction between the inner surface of the cardboard box and the outer surface of the mandrel). In the folding unit 20 of the packaging machine 18 described above, this compromise (second-rate, as it obliges the penalization of both the quality of the folding and the ease of extraction) is completely avoided by using the mandrels 37 which can modify its cross section due to the mutual movement between the two parts 49 and 50, thus presenting in each situation the optimum cross section. In other words, when the mandrels 37 must be "large" to optimize the folding of the blank 9 the mandrels assume the expanded configuration (illustrated in FIG. 13) whereas when mandrels 37 must be "small" to optimize the extraction of the empty 2 cardboard boxes, that just have been formed, the mandrels assume the contracted configuration (illustrated in FIG. 14).

The displacement of the mandrels 37 between the expanded configuration and the contracted configuration is preferably controlled, but not necessarily, by a camming system 51 (schematically shown in FIGS. 13 and 14) which takes motion from the rotation of the folding drum 34 around the rotation axis 35. Among other things, the camming system 51 comprises, for each mandrel 37, a slider 52 which is axially movable (i.e. parallel to the rotation axis 43) and controls the movement of the mandrel 37 between the expanded configuration (illustrated in FIG. 13) and the contracted configuration (illustrated in FIG. 14). According to a preferred but non-binding embodiment, the camming system 51, that controls the movement of the parts 49 and 50 of each mandrel 37, is devoid of elastic elements.

In the embodiment illustrated in the accompanying figures, in each mandrel 37 the movement of the movable part 50 relative to the fixed part 49 determines the variation in the size (cross section) of the mandrel 37 only in one direction (in particular in the width and not in the thickness and in axial length). According to an alternative embodiment not illustrated, in each mandrel 37 the movement of the movable part 50 relative to the fixed part 49 determines the variation in the size (cross section) of the mandrel 37 only in two directions perpendicular to one another (in particular in the width and in the thickness and not in axial length).

Figure 15:
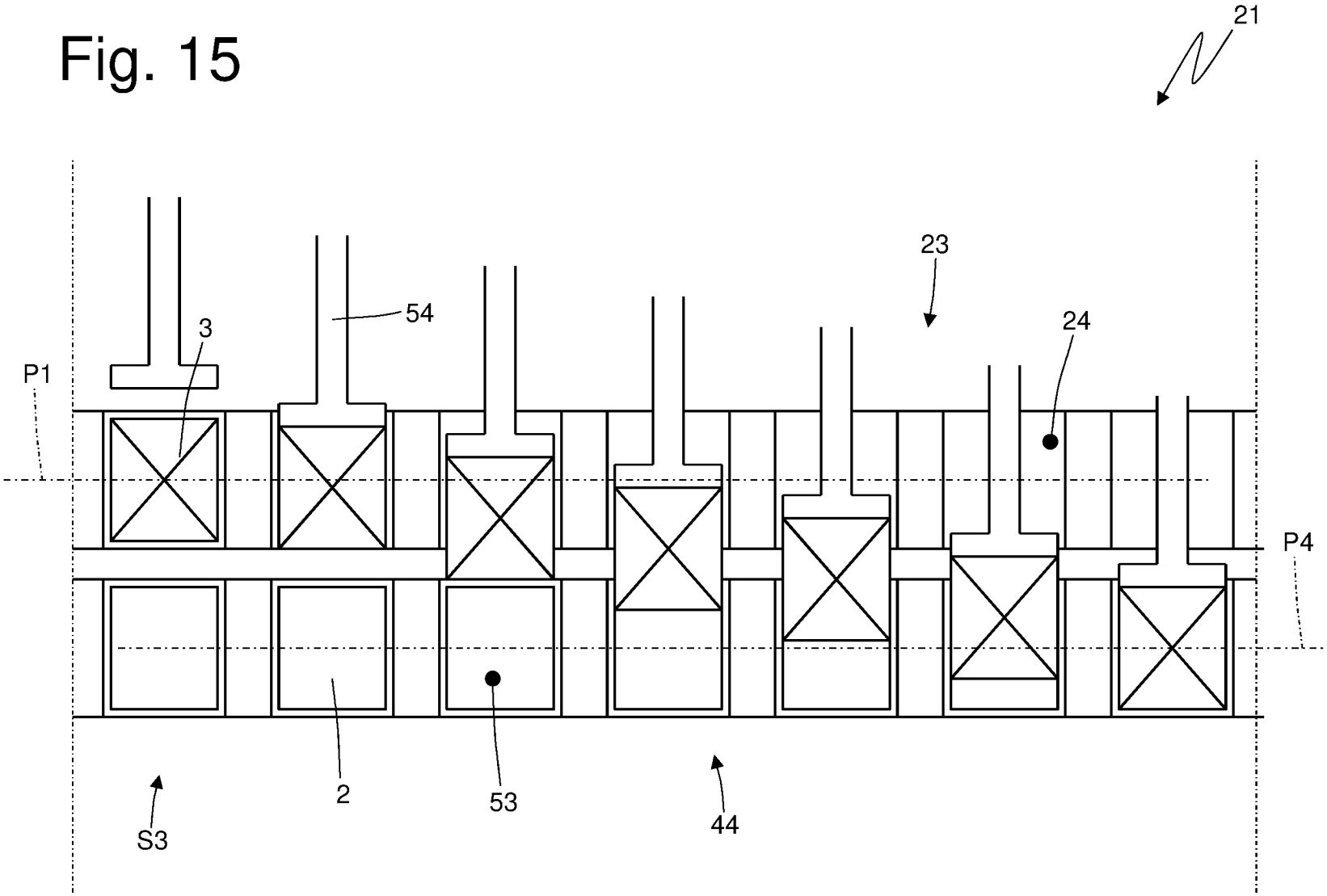
FIG. 15 is a schematic plan view of an inserting unit of the packaging machine of FIG. 4.

As illustrated in FIG. 15, the insertion unit 21 comprises the refining conveyor 44 which is in common with the subsequent closing unit 22; in other words, the same refining conveyor 44 feeds the cardboard boxes 2 containing the groups 3 of articles (i.e. the packages 1) both through the insertion unit 21, and through the subsequent closing unit 22. The refining conveyor 44 feeds a series of refining pockets 53 along a straight and horizontal refining path P4 which is parallel and flanked to the formation path P1; preferably, the refining conveyor 44 comprises (at least) a flexible belt which is closed in a loop around two end pulleys (at least one of which is motorized) and supports the refining pockets 53.

The refining conveyor 44 is arranged, for a given section, beside the formation conveyor 23, that is, at the insertion unit 21, an initial section of the refining conveyor 44 is flanked by a final section of the formation conveyor 23. Furthermore, the initial section of the refining conveyor 44 is arranged at the transfer station S3. In use, the folding drum 34 of the folding unit 20 feeds the empty cardboard boxes 2, that have just been formed, in the transfer station S3 to the refining conveyor 44 of the insertion unit 21; in other words, in the transfer station S3 the empty cardboard boxes 2, that have just been formed, are cyclically transferred from the folding heads 36 of the folding drum 34 to the refining pockets 53 of the refining conveyor 44. This transfer can take place directly (i.e. the empty cardboard boxes 2, that have just been formed, pass directly from the folding heads 36 of the folding drum 34 to the refining pockets 53 of the refining conveyor 44 without intermediaries) or this transfer can take place indirectly (i.e. between the folding drum 34 and the refining conveyor 44 an intermediate conveyor is interposed, which receives in delivery the empty cardboard boxes 2, that have just been formed, it passes from the folding heads 36 of the folding drum 34 and subsequently releases the empty cardboard boxes 2, that have just been formed, to the refining pockets 53 of the refining conveyor 44).

As previously stated, to release an empty cardboard box 2, that has just been formed, the corresponding folding head 36 arranges the empty cardboard box 2 in the destination (for example a refining pocket 53 of the refining conveyor 44) and then moves (axially translates) its own mandrel 37 (which is in the contracted configuration to facilitate the axial unravelling) from the work position to the rest position; said axial movement of the mandrel 37 determines the axial unravelling of the mandrel 37 from the empty cardboard box 2, that has just been formed, and therefore the empty cardboard box 2, that has just been formed, is released from the folding head 36 and remains engaged only by the destination (for example a refining pocket 53 of the refining conveyor 44). In other words, for a small period of time the empty cardboard box 2, that has just been formed, is engaged both by the destination (for example a refining pocket 53 of the refining conveyor 44) and by the mandrel 37 of the folding head 36; when the mandrel 37 of the folding head 36 moves (axially translates) from the work position to the rest position, the mandrel 37 is axially unravelled from the empty cardboard box 2, that has just been formed, leaving the empty cardboard box 2, that has just been formed, only in the destination (for example a refining pocket 53 of the refining conveyor 44).

As better illustrated in FIGS. 11 and 12, each folding head 36 comprises a support body 46 which is hinged to the folding drum 34 so as to rotate around the corresponding rotation axis 43. In each folding head 36 the body 46 that carries the mandrel 37 which is mounted on the support body 46 to axially slide along an axial translational direction, i.e. parallel to the rotation axis 43, between a work position (illustrated for example in FIGS. 11 and 12), in which the mandrel 37 protrude from the folding drum 34, and a release position, in which the mandrel 37 does not protrudes in a cantilever fashion from the folding drum 34. Along the folding path P2, the mandrels assume the work position everywhere except in the transfer station S3 and the mandrels 37 assume the release position only in the transfer station S3 (according to methods better described in the following).

The insertion unit 21 comprises a series of pushers 54 which move the paths P1 and P4, in parallel, synchronously with the conveyors 23 and 44 and push the groups 3 of articles from the formation pockets 24 of the formation conveyor 23 into the refining pockets 53 of the refining conveyor 44, i.e. inside the empty 2 cardboard boxes carried by the refining pockets 53 of the refining conveyor 44. The insertion unit 21 comprises an actuator device which moves the pusher 54 by imparting, to the pushers 54, both a feed movement parallel to the paths P1 and P4 and synchronized with the two conveyors 23 and 44, and an insertion movement perpendicular to the paths P1 and P4.

In other words, in the insertion unit 21 each group 3 of articles is longitudinally inserted into a corresponding empty cardboard box 2: the formation conveyor 23 advances with continuous motion synchronously with the refining conveyor 44 and the pushers 54 advance with a continuous motion synchronously with the two conveyors 23 and 44 and are moving perpendicularly to the paths P1 and P4 for axially transferring each group 3 of articles from a formation pocket 24 of the formation conveyor 23 to a refining pocket 53 of the refining conveyor 44.

The closing unit 22 comprises folding devices (per se of known type) which fold the fins 17 against one another to close the cardboard boxes 2 and then complete the formation of the packages 1. The closing unit 22 comprises, furthermore, gluing devices, which are arranged near the refining conveyor 44 and along the refining path P4 for applying glue (preferably hot, i.e. preferably quick-setting) to the fins 17; preferably, the gluing devices of the closing unit 22 are of the spraying type, i.e. it comprises one or more glue guns which are activated to supply a pressurized spray of glue towards the fins 17.

According to a possible illustrated embodiment, the closing unit 22 comprises a printing device (for example an ink jet printer), which is arranged along the refining conveyor 44 to print at least one identification code (for example containing packaging date and place) on a wall of each cardboard box 2 carried by the refining conveyor 44.

The embodiments described herein can be combined without departing from the scope of protection of the present invention.

The packaging machine 18 described above has numerous advantages.

First of all, the packaging machine 18 described above allows to achieve high hourly productivity while ensuring a high-quality standard.

Furthermore, the packaging machine 18 is relatively compact and relatively inexpensive as it directly performs the folding of the blanks 9, i.e. it receives the flat blanks 9 devoid of any prior folding.

These results are obtained mainly, but not exclusively, by the fact of using mandrels 37 of variable size which become "large" to optimize the folding of the blank 9 and become "small" to optimize the unravelling of the empty cardboard boxes 2 that has just been formed; in this way it is possible to obtain, at the same time, a high hourly productivity and also a high quality standard.

Following the advantages obtainable with the use of mandrels 37 of variable size, the use of mandrels 37 of variable size can also be applied to the manufacture of empty cardboard boxes 2 which are adapted to contain products other than those described above (also outside of the tobacco field). In other words, the use of mandrels 37 of variable size is not limited to the manufacturing of empty cardboard boxes 2 designed to contain the groups 3 of heterogeneous articles described above, but the use of mandrels 37 of variable size can find advantageous application in the manufacturing of empty cardboard boxes 2 adapted to contain any type of product (also outside the tobacco field).

The invention claimed is:

1. A folding unit (20) for forming an empty cardboard box (2), the folding unit (20) comprising:

a mandrel (37) around which a blank (9) is folded to form the empty cardboard box (2); and a folding head (36) which supports the mandrel (37);

wherein the mandrel (37) comprises at least two parts (49, 50) that are mobile with respect to one another between an expanded configuration in which the at least two parts (49, 50) are further from one another so as to confer a maximum size to the mandrel (37), and a contracted configuration in which the at least two parts (49, 50) are closer to one another so as to confer a minimum size to the mandrel (37);

wherein the folding head (36) supports the mandrel (37) so as to slide the mandrel (37) between a work position in which the mandrel (37) completely protrudes in a cantilever fashion from the folding head (36), and a transfer position in which the mandrel (37) moves backwards from the work position with a stroke that is greater than an axial extension of the empty cardboard box (2);

wherein by moving from the expanded configuration to the contracted configuration and by moving from the work position to the transfer position, the mandrel (37) is axially and completely unraveled from the empty cardboard box (2) that has just been formed; and wherein the folding head (36) supports at least one locking element (47) which is arranged on a side of the mandrel (37) and is movable between a locking position, in which the at least one locking element (47) is pressed against a corresponding side wall of the mandrel (37), and a release position, in which the at least one locking element (47) is far from the corresponding side wall of the mandrel (37).

2. The folding unit (20) according to claim 1, wherein:

the mandrel (37) is in the expanded configuration when the blank (9) is folded around the mandrel (37) so as to form the empty cardboard box (2); and the mandrel (37) assumes the contracted configuration when the empty cardboard box (2) is axially unravelled from the mandrel (37).

3. The folding unit (20) according to claim 1, wherein:

the expanded configuration confers a maximum cross section to the mandrel (37), which is equal, without clearance, to an inner cross section of the cardboard box (2); and the contracted configuration confers a minimum cross section to the mandrel (37), which is smaller than the inner cross section of the cardboard box (2).

4. The folding unit (20) according to claim 1, further comprising an actuation system (51) which alternatively imparts the expanded configuration and the contracted configuration to the mandrel (37).

5. The folding unit (20) according to claim 1, wherein mutual movement of the at least two parts (49, 50) of the mandrel (37) determines variation of a cross section of the mandrel (37) only in one direction.

6. The folding unit (20) according to claim 1, wherein mutual movement of the at least two parts (49, 50) of the mandrel (37) determines variation of a cross section of the mandrel (37) in two perpendicular directions.

7. The folding unit (20) according to claim 1, wherein a movable part (50) of the mandrel (37) is mounted in a cantilever fashion on a fixed part (49) of the mandrel (37) so as to linearly slide relative to the fixed part (49).

8. The folding unit (20) according to claim 1, wherein the at least one locking element (47) is arranged at glued areas of the blank (9) so as to apply, in the locking position, a pressure at the glued areas.

9. The folding unit (20) according to claim 1, wherein:

the folding head (36) comprises a support body (46), on which the mandrel (37) is mounted; and the at least one locking element (47) is hinged to the support body (46) so as to rotate between the locking position and the release position.

10. The folding unit (20) according to claim 1, wherein the at least one locking element (47) comprises two locking elements (47), which are arranged on opposite sides of the mandrel (37).

11. The folding unit (20) according to claim 1, wherein the mandrel (37) axially translates from the work position to the transfer position so as to free the empty cardboard box (2) that has just been formed.

12. The folding unit (20) according to claim 11, wherein the mandrel (37) is moved from the expanded configuration to the contracted configuration when and only when the mandrel (37) axially translates from the work position to the transfer position so as to free the empty cardboard box (2) that has just been formed.

13. The folding unit (20) according to claim 1, further comprising:

a storage unit (38) containing a pile of blanks (9);

a folding drum (34) that rotates with a continuous motion around a first rotation axis (35) and supports the folding head (36) provided with the mandrel (37) so as to move the folding head (36) between a feeding station (S2) in which the blank (9) is coupled to the mandrel (37) and a transfer station (S3) in which the empty cardboard box (2) is released from the mandrel (37); and folding means, which are arranged between the feeding station (S2) and the transfer station (S3) and which fold the blank (9) into a tubular shape around the mandrel (37) so as to form the empty cardboard box (2).

14. The folding unit (20) according to claim 13, wherein the folding head (36) is hinged to the folding drum (34) so as to rotate, relative to the folding drum (34), around a second rotation axis (43) which is parallel to and spaced from the first rotation axis (35).

15. A packaging machine (18) for manufacturing a package (1) comprising a cardboard box (2) and a group (3) of articles, the packaging machine (18) comprising:

the folding unit (20) of claim 1, in which an empty cardboard box (2) is manufactured;

an insertion unit (21), in which the group (3) of articles is longitudinally inserted into the previously manufactured empty cardboard box (2); and a closing unit (22), in which open ends of the cardboard box (2) are closed so as to complete manufacturing of the package (1).

16. The packaging machine (18) according to claim 15, wherein:

the group (3) of articles comprises at least two heterogeneous articles; and a formation unit (19) is provided, which forms the group (3) of heterogeneous articles and supplies the group (3) of articles to the insertion unit (21).

17. A folding method for forming an empty cardboard box (2), the folding method comprising the steps of:

folding a blank (9) around a mandrel (37) supported by a folding head (36) so as to form the empty cardboard box (2); and moving at least two parts (49, 50) of the mandrel (37) relative to one another between an expanded configuration, in which the at least two parts (49, 50) are further from one another so as to confer a maximum size to the mandrel (37), and a contracted configuration, in which the at least two parts (49, 50) are closer to one another so as to confer a minimum size to the mandrel (37);

wherein the folding head (36) supports the mandrel (37) so as to slide the mandrel (37) between a work position in which the mandrel (37) completely protrudes in a cantilever fashion from the folding head (36), and a transfer position in which the mandrel (37) moves backwards from the work position with a stroke that is greater than an axial extension of the empty cardboard box (2);

wherein by moving from the expanded configuration to the contracted configuration and by moving from the work position to the transfer position, the mandrel (37) is axially and completely unraveled from the empty cardboard box (2) that has just been formed; and wherein the folding head (36) supports at least one locking element (47) which is arranged on a side of the mandrel (37) and is movable between a locking position, in which the at least one locking element (47) is pressed against a corresponding side wall of the mandrel (37), and a release position, in which the at least one locking element (47) is far from the corresponding side wall of the mandrel (37).

18. A folding unit (20) for forming an empty cardboard box (2), the folding unit (20) comprising:

a mandrel (37) around which a blank (9) is folded to form the empty cardboard box (2);

a folding head (36) which supports the mandrel (37);

a storage unit (38) containing a pile of blanks (9);

a folding drum (34) that rotates with a continuous motion around a first rotation axis (35) and supports the folding head (36) provided with the mandrel (37) so as to move the folding head (36) between a feeding station (S2) in which the blank (9) is coupled to the mandrel (37) and a transfer station (S3) in which the empty cardboard box (2) is released from the mandrel (37); and folding means, which are arranged between the feeding station (S2) and the transfer station (S3) and which fold the blank (9) into a tubular shape around the mandrel (37) so as to form the empty cardboard box (2);

wherein the mandrel (37) comprises at least two parts (49, 50) which are mobile with respect to one another between an expanded configuration in which the at least two parts (49, 50) are further from one another so as to confer a maximum size to the mandrel (37), and a contracted configuration in which the at least two parts (49, 50) are closer to one another so as to confer a minimum size to the mandrel (37);

wherein the folding head (36) supports the mandrel (37) so as to slide the mandrel (37) between a work position in which the mandrel (37) completely protrudes in a cantilever fashion from the folding head (36) and a transfer position in which the mandrel (37) moves backwards from the work position with a stroke that is greater than an axial extension of the empty cardboard box (2); and wherein by moving from the expanded configuration to the contracted configuration and and by moving from the work position to the transfer position, the mandrel (37) is axially and completely unravelled from the empty cardboard box (2) that has just been formed.

19. The folding unit (20) according to claim 18, wherein the folding head (36) is hinged to the folding drum (34) so as to rotate, relative to the folding drum (34), around a second rotation axis (43) which is parallel to and spaced from the first rotation axis (35).

20. The folding unit (20) according to claim 18, wherein:

the mandrel (37) is in the expanded configuration when the blank (9) is folded around the mandrel (37) so as to form the empty cardboard box (2); and the mandrel (37) assumes the contracted configuration when the empty cardboard box (2) is axially unravelled from the mandrel (37).

21. The folding unit (20) according to claim 18, wherein:

the expanded configuration confers a maximum cross section to the mandrel (37), which is equal, without clearance, to an inner cross section of the cardboard box (2); and the contracted configuration confers a minimum cross section to the mandrel (37), which is smaller than the inner cross section of the cardboard box (2).

22. The folding unit (20) according to claim 18, further comprising an actuation system (51) which alternatively imparts the expanded configuration and the contracted configuration to the mandrel (37).

23. The folding unit (20) according to claim 18, wherein mutual movement of the at least two parts (49, 50) of the mandrel (37) determines variation of a cross section of the mandrel (37) only in one direction.

24. The folding unit (20) according to claim 18, wherein mutual movement of the at least two parts (49, 50) of the mandrel (37) determines variation of a cross section of the mandrel (37) in two perpendicular directions.

25. The folding unit (20) according to claim 18, wherein a movable part (50) of the mandrel (37) is mounted in a cantilever fashion on a fixed part (49) of the mandrel (37) so as to linearly slide relative to the fixed part (49).

26. The folding unit (20) according to claim 18, wherein the mandrel (37) axially translates from the work position to the transfer position so as to free the empty cardboard box (2) that has just been formed.

27. The folding unit (20) according to claim 26, wherein the mandrel (37) is moved from the expanded configuration to the contracted configuration when and only when the mandrel (37) axially translates from the work position to the transfer position so as to free the empty cardboard box (2) that has just been formed.

28. A packaging machine (18) for manufacturing a package (1) comprising a cardboard box (2) and a group (3) of articles, the packaging machine (18) comprising:

the folding unit (20) of claim 18, in which an empty cardboard box (2) is manufactured;

an insertion unit (21), in which the group (3) of articles is longitudinally inserted into the previously manufactured empty cardboard box (2); and a closing unit (22), in which open ends of the cardboard box (2) are closed so as to complete manufacturing of the package (1).

29. The packaging machine (18) according to claim 28, wherein:

the group (3) of articles comprises at least two heterogeneous articles; and a formation unit (19) is provided, which forms the group (3) of articles and supplies the group (3) of articles to the insertion unit (21).

* * * * *